US005482480A

United States Patent [19]

Miyazaki

[11] Patent Number: 5,482,480

[45] Date of Patent: Jan. 9, 1996

[54] CONNECTOR TERMINAL

[75] Inventor: Sho Miyazaki, Yokkaichi, Japan

[73] Assignee: Sumitomo Wiring Systems, Ltd., Mie, Japan

[21] Appl. No.: 213,583

[22] Filed: Mar. 16, 1994

[30] Foreign Application Priority Data

Mar. 18, 1993 [JP] Japan ..... 5-085783

[51] Int. Cl.[6] ..... H01R 4/50

[52] U.S. Cl. ..... 439/774; 439/772; 439/825

[58] Field of Search ..... 439/824, 825, 439/848, 849, 850, 843, 842, 851–856, 861, 772, 774

[56] References Cited

U.S. PATENT DOCUMENTS

| | | | |
|---|---|---|---|
| 3,065,450 | 11/1962 | Fieberg | 439/825 |
| 3,716,817 | 2/1973 | Wolfe, Jr. et al. | 439/848 |
| 3,894,785 | 7/1975 | Hubner et al. | 439/825 |
| 4,405,195 | 9/1983 | Cherry et al. . | |
| 4,867,697 | 9/1989 | Borges . | |
| 4,867,714 | 9/1989 | Owen | 439/848 |
| 4,938,720 | 7/1990 | Romak . | |
| 5,197,908 | 3/1993 | Nelson | 439/825 |

FOREIGN PATENT DOCUMENTS

| | | |
|---|---|---|
| 520869 | 3/1931 | Germany . |
| 190251 | 4/1937 | Switzerland . |
| 256321 | 2/1949 | Switzerland . |
| 1120358 | 7/1968 | United Kingdom . |

*Primary Examiner*—David L. Pirlot
*Attorney, Agent, or Firm*—Oliff & Berridge

[57] ABSTRACT

A connector requiring minimal insertion force and forming a reliable connection has a female terminal and a male terminal. A shaft portion of the male terminal is insertable into a closed end insertion tubular portion of the female terminal. The shaft portion has an expanding slot extending along a length thereof. A projection is provided within the insertion tubular portion near the closed end. A bore diameter of the insertion tubular portion is larger than a diameter of a portion of the shaft portion that is to be first inserted. At a final stage of an insertion operation, the projection fits in the expanding slot. Accordingly, at the final stage of the insertion operation, the shaft portion is forcibly expanded radially outward and brought into contact with the bore wall of the insertion tubular portion at a predetermined contact pressure.

25 Claims, 5 Drawing Sheets

CONNECTOR TERMINAL

BACKGROUND OF THE INVENTION

This invention relates to a connector terminal, and more particularly to a connector terminal for connecting large electrical currents.

In a commonly-used connector, a male terminal is inserted into a female terminal, thereby forming an electrical connection. In this case, particularly in the type of connector for dealing with a larger current, a highly reliable connection between the two terminals is required. Therefore, a construction shown in FIG. 7 is adopted. This figure shows one of many pairs of mating terminals provided in female and male connector housings that are to be fitted together.

The female terminal 20 shown in FIG. 7 has an insertion tubular portion 21 at its front portion, and the male terminal 22 has a shaft portion 23, which can be inserted into the insertion tubular portion 21. In this case, the outer diameter of the shaft portion 23 is slightly larger than a bore diameter of the insertion tubular portion 21; and the shaft portion 23 is divided along an axial direction by an expanding slot 24 extending along a longitudinal axis thereof. With this arrangement, by forcibly deforming the entire shaft portion 23 radially inward, the shaft portion 23 can be inserted into the tubular portion 21. Accordingly, when the male terminal 22 and the female terminal 20 are connected, an adequate contact pressure can be achieved due to a resilient restoring force of the shaft portion 23 of the male terminal 22.

However, the following problems have been encountered with the above connector construction. First, in the above construction, a large contact resistance is maintained over a time period starting with the insertion of the terminal 22 into the terminal 20 until completion of the insertion operation. Therefore, the insertion operation is difficult, in particular, because the larger an allowable current is, the larger the size of the terminals become, and therefore a larger insertion force is needed to construct the connector.

Furthermore, when the insertion and withdrawal of the terminal are repeated, or when the terminals remain in an inserted position for a long period of time, the resilient restoring force of the male terminal 22 may be decreased, and as a result, the contact pressure is decreased. In addition, when the terminals are in a withdrawn position, the outer diameter of a front end of the shaft portion 23 is larger than the bore diameter of the insertion tubular portion 21, and therefore the insertion at an initial stage is difficult.

SUMMARY OF THE INVENTION

The present invention has been made in consideration of the foregoing. Accordingly, an object of the invention is to provide a connector terminal in which the insertion of a terminal can be easily achieved, and connection reliability is enhanced.

This and other objects of the present invention have been achieved by providing a connector terminal including a female terminal having an insertion tubular portion of a cylindrical shape, and a shaft-like male terminal insertable into the female terminal. The male terminal can be loosely fitted in the insertion tubular portion. The male terminal has an expanding slot formed therein, so that the male terminal can be deformed radially outward. A projection is provided at a predetermined depth within the insertion tubular portion for forcibly expanding the expanding slot of the male terminal to bring the male terminal into contact with an inner surface of the insertion tubular portion.

In accordance with the invention, a diameter of a front end portion of the male terminal is smaller than a bore diameter of the insertion tubular portion. Therefore, at initial and intermediate stages of an insertion operation, a minimal insertion force can be used. At the end of the insertion operation, the projection is fitted into the expanding slot to forcibly deform the male terminal radially outward. As a result, the male terminal is in contact with the bore wall of the insertion tubular portion, thus electrically connecting the two connectors together.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

Figure 1:
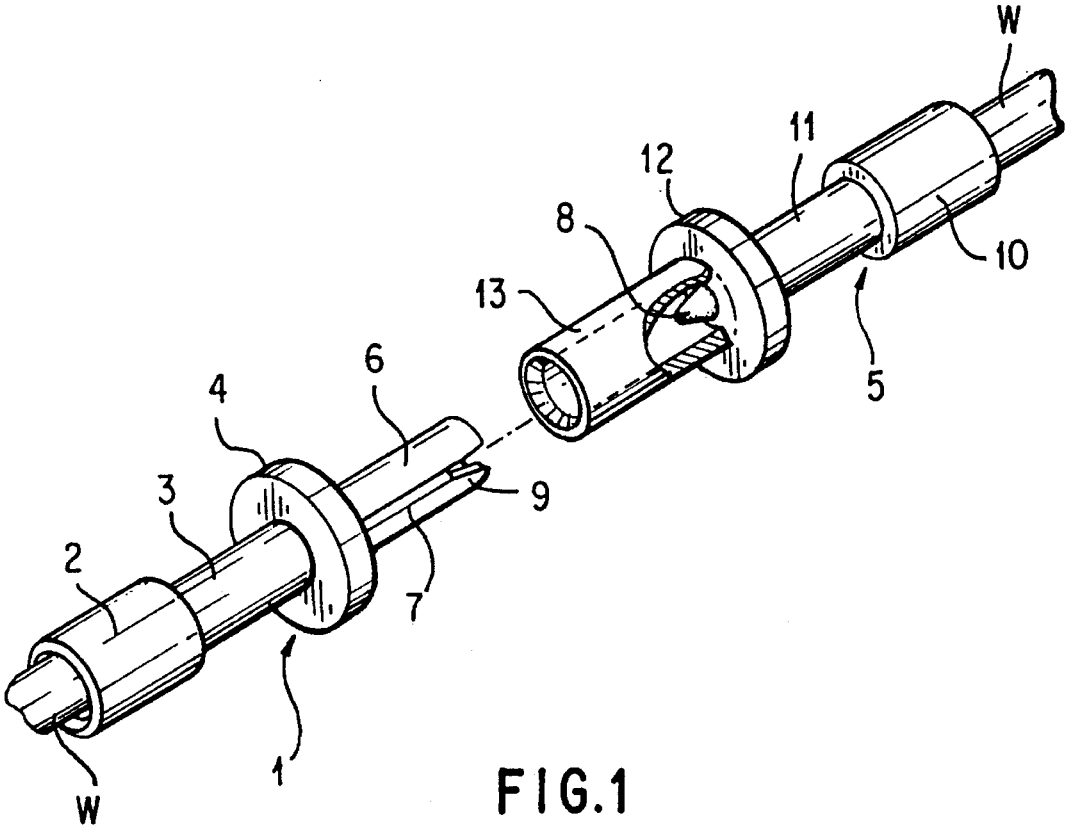
FIG. 1 is a perspective view of a first embodiment of the invention.
Figure 2:
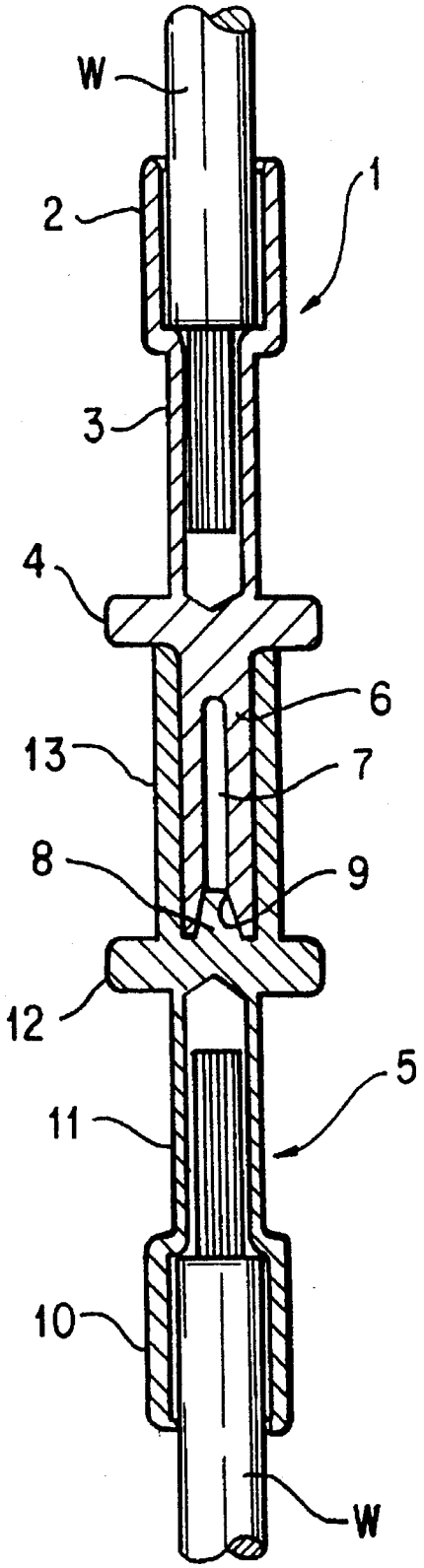
FIG. 2 is a cross-sectional view showing the terminals connected together.

Preferred embodiments of the present invention will now be described in detail with reference to the drawings. FIGS. 1–4 show a first embodiment of the present invention. For purposes of illustration, the invention will be described for use in, for example, a terminal used for a charging connector for an electric car. The charging connector includes charging connectors to be connected to the car and a charger, respectively. Terminals for allowing a relatively large current (for example, 30~90 A) are mounted within housings of the connectors. Each of the embodiments shown in the attached figures are for purposes of illustration and show only one of many possible pairs of male and female terminals for use in accordance with the invention, and the invention is not meant to be limited thereto.

The male terminal 1 is made of an electrically-conductive material, and has at one end, for example, its rear end portion, a larger-diameter portion 2 serving as a cord insertion portion for inserting a covered portion of a wire w thereinto. A smaller-diameter portion 3 is provided in communication with the larger-diameter portion 2, and a conductor portion of the wire W is inserted into the smaller-diameter portion 3. A flange 4 is formed in a continuous relationship with the smaller-diameter portion 3, and a shaft portion 6 insertable into a female terminal 5 extends in one direction, for example, forwardly from the flange 4. The shaft portion 6 is divided into a bifurcated configuration by an expanding slot 7, which is formed in the shaft portion 6 and extends axially from one end face, for example, a front end face thereof to a vicinity of the flange 4. In accordance with this embodiment of the invention, the shaft portion 6 can be resiliently deformed in an expansive direction, that is, in a diameter-increasing direction. The shaft portion 6 has at its front end a tapered opening 9 flaring outwardly into a conical shape. A conical projection 8 (described later) on the female terminal 5 can be fitted in the opening 9. The shaft portion 6 decreases in diameter progressively toward its front end.

In addition, the female terminal 5, similar to the male terminal 1, is made of an electrically-conductive material, and has a larger-diameter portion 10, a smaller-diameter portion 11 and a flange 12. Extending in one direction, for example, forwardly from the flange 12 is an insertion tubular portion 13 into which the shaft portion 6 of the male terminal 1 is adapted to be inserted. The insertion tubular portion 13 is in the form of a hollow cylinder having a closed end, for example, a closed bottom and has a bore diameter slightly larger than an outer diameter of the front end portion of the shaft portion 6. The insertion tubular portion 13 has such an overall length such that when the shaft portion 6 is completely inserted into the insertion tubular portion 13 one end or edge, for example, a front end or edge of the insertion tubular portion 13 substantially abuts against the flange 4 of the male terminal 1.

In addition, the projection 8 for forcibly expanding the shaft portion 6 is coaxially formed on and projected from the bottom surface of the insertion tubular portion 13. The projection 8 can be aligned with the tapered opening 9, and has a frusto-conical shape larger in size than the opening 9. Accordingly, when the male and female terminals 1 and 5 are completely connected together, the projection 8 fits in the opening 9, so that the shaft portion 6 is expanded to a diameter substantially equal to the bore diameter of the insertion tubular portion 13 over substantially the entire length thereof. Therefore, the entire shaft portion 6 is held in contact with the bore surface of the insertion tubular portion 13 at a predetermined contact pressure.

Figure 3:
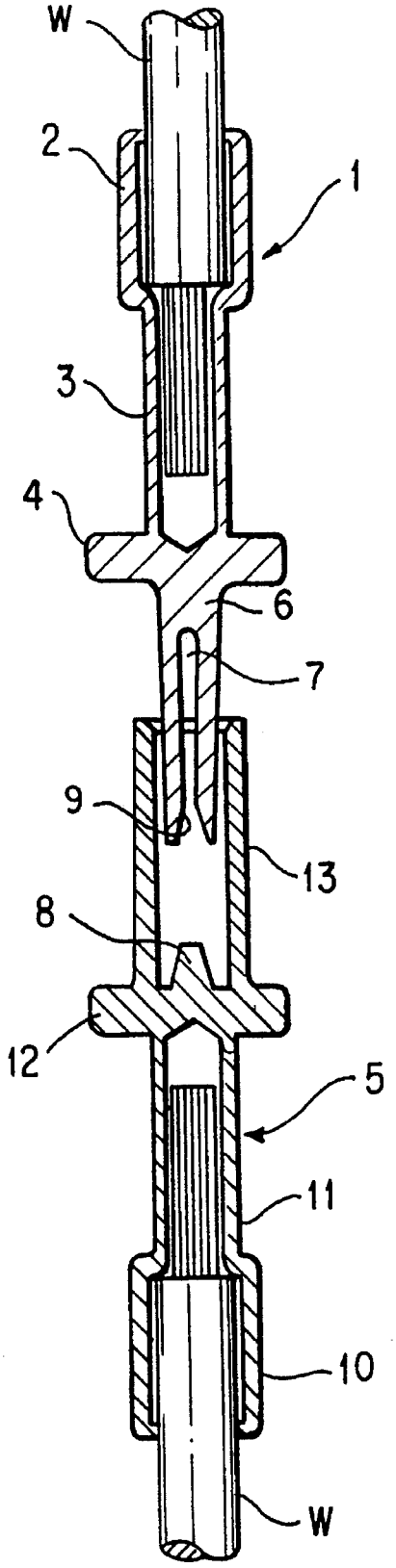
FIG. 3 is a cross-sectional view showing an initial stage of the insertion of the terminal.
Figure 4:
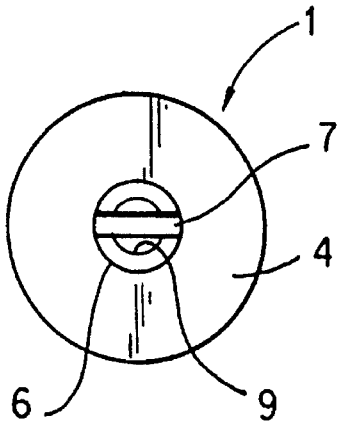
FIG. 4 is a side-elevational view of the male terminal.

In accordance with a first embodiment of the invention, and by fitting the two connector housings (not shown) together, the insertion of the male terminal 1 into the female terminal 5 is achieved. In this embodiment, at an initial stage of the insertion operation, since the front end portion of the shaft portion 6 is smaller in diameter than the insertion tubular portion 13 as shown in FIG. 3, the insertion proceeds in such a manner that a predetermined gap is provided between the shaft portion 6 and the insertion tubular portion 13. Therefore, the operation of fitting of the two terminals together can be easily achieved, and the operating force required during the insertion is minimal.

In accordance with the invention, when the front end of the shaft portion 6 reaches the bottom of the insertion tubular portion 13, the projection 8 becomes fitted in the tapered opening 9 of the shaft portion 6. At this point, the shaft portion is forcibly inserted, and the opening 9 is expanded so that the entire shaft portion 6 is brought into contact with the inner surface of the insertion tubular portion 13 at the predetermined contact pressure.

As discussed above, in accordance with the first embodiment of the invention, the insertion force required at an initial and intermediate stage of the insertion operation is minimal, and additional force is applied at a final stage of the insertion operation. Therefore, the insertion operation can be easily achieved and the operator can know when the terminal connecting operation is complete.

Since the shaft portion 6 is forcibly expanded by the projection 8, an absolute contact between the shaft portion 6 and the insertion tubular portion 13 can be achieved. Therefore, even if a resilient restoring force of the shaft portion 6 is decreased, the absolute contact can be ensured. Accordingly, this embodiment of the invention is particularly well-suited for a large current type connector. Furthermore, in the first embodiment of the invention, the projection 8 is formed in a frusto-conical shape, and therefore no directionality is needed, for example, with respect to a reference point, to insert the shaft portion 6. Accordingly, the terminal can be advantageously inserted without being aligned in any particular direction.

Figure 5:
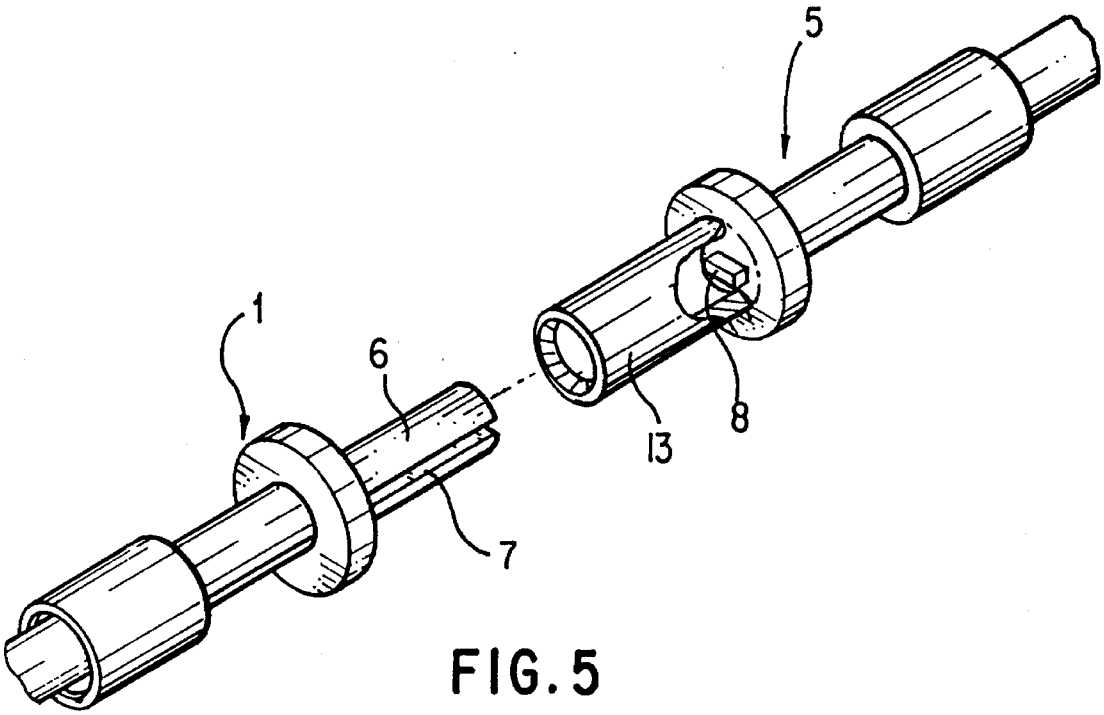
FIG. 5 is a perspective view of a second embodiment of the invention.

However, it is not always necessary that the projection 8 be formed into a non-directional configuration as discussed above in accordance with the first embodiment. For example, in a second embodiment shown in FIG. 5, a projection 8 is in the form of a flat plate, and accordingly, a shaft portion 6 is divided into two sections by an expanding slot 7. The shaft portion 6 decreases in diameter progressively toward its front end, and the projection 8, when engaged with the expanding slot 7, forcibly expands the front end portion of the shaft portion. As a result, the shaft portion 6 is brought into contact with the inner surface of the insertion tubular portion 13 over substantially an entire length of the shaft portion 6.

Figure 6:
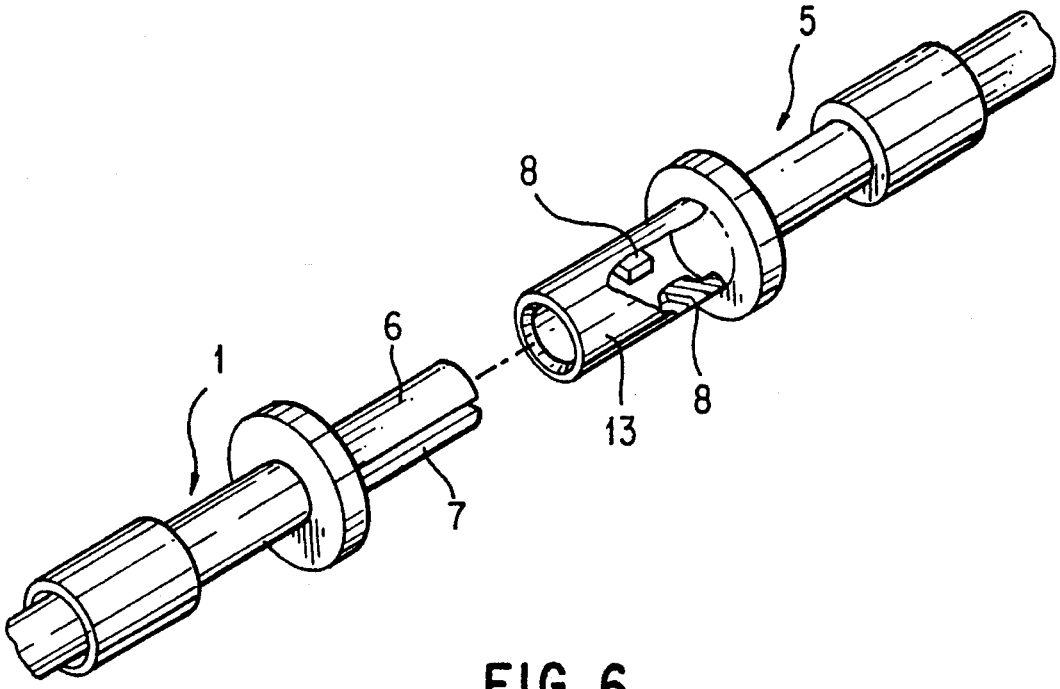
FIG. 6 is a perspective view of a third embodiment of the invention.
Figure 7:
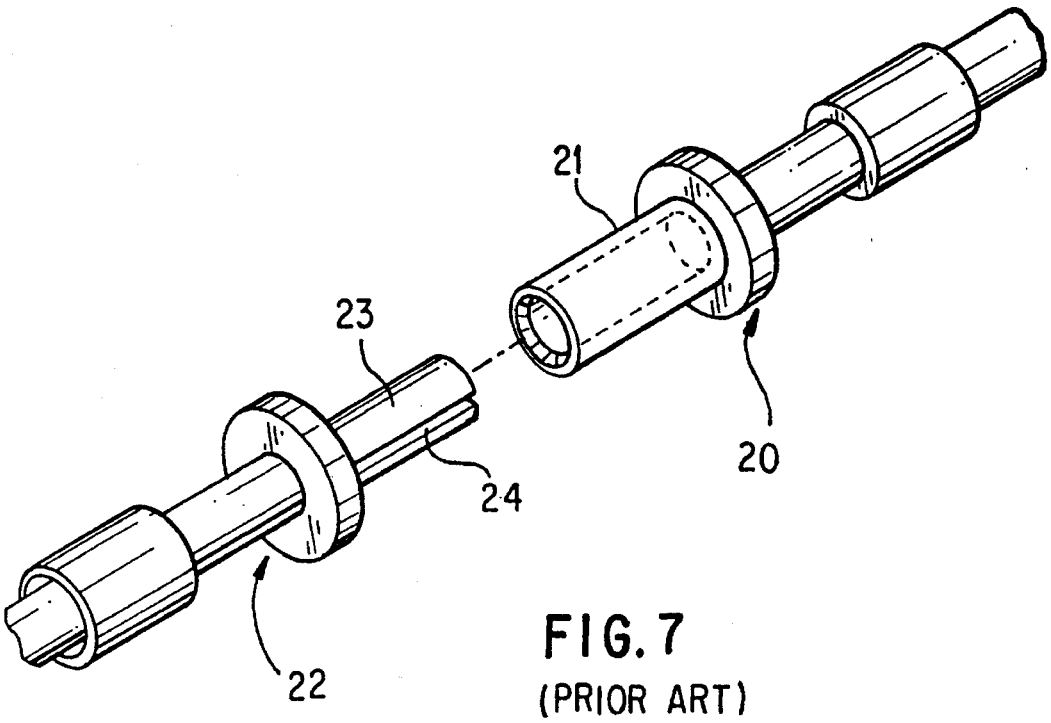
FIG. 7 (PRIOR ART)
FIG. 7 is a perspective view showing related art terminals.

Although in the first and second embodiments in accordance with the invention, the projection 8 is on the bottom surface of the insertion tubular portion 13, it is within the scope of the invention to provide the projection at any other suitable position in so far as the projection can expand the shaft portion 6 at the final stage of the insertion operation. For example, the projection 8 may be provided on a side wall of the insertion tubular portion 13 as in a third embodiment shown in FIG. 6. In accordance with this embodiment of the invention, the insertion tubular portion 13 does not require the bottom surface. Further, in accordance with the invention, the expanding slot 7 is not limited to a single expanding slot 7 as shown, rather, a plurality of expanding slots may be provided. In addition, a geometry of the shape of the projection 8 can be modified to incorporate a variety of different shapes, for example, a pin-like projection of a circular cross-section. Furthermore, the projection or projections 8 of any of the various shapes can be provided on the bottom surface or transversely on opposite portions of the side wall. Furthermore, although the present invention has been discussed above in an embodiment for use in the charging connector for an electric car, this embodiment is for purposes of illustration only, and it is within the scope of the invention to apply the invention to any type of connectors.

By these constructions, a minimal insertion force is required at the initial and intermediate stages of the insertion operation. Accordingly, a predetermined insertion force is applied only at the final stage. Therefore, the insertion operation is not difficult, and due to the increased insertion force required at the final stage of the insertion operation, the operator can know when the connection is completed. During the final stage, the projection forcibly expands the male terminal, so that the male terminal contacts the insertion tubular portion, thereby enhancing the reliability of the connection between the terminals.

While advantageous embodiments have been chosen to illustrate the invention, it will be understood by those skilled in the art that various changes and modifications can be made therein without departing from the scope of the invention as defined in the appended claims.

What is claimed is:

1. A connector terminal, comprising:

a first terminal having a tubular portion with an inner diameter, said tubular portion having at least one projection, said projection being blade-like and having a width substantially equal to said inner diameter; and a second terminal having a shaft portion insertable in said tubular portion and a slot, wherein said projection enters into said slot to expand said shaft portion from an insertion diameter less than the inner diameter in a first position to an expanded diameter substantially equal to the inner diameter in a second position.

2. The connector terminal according to claim 1, wherein said tubular portion has a closed end, the at least one projection being disposed on the closed end.

3. The connector terminal according to claim 1, wherein the slot of the shaft portion tapers at its end.

4. The connector terminal according to claim 1, wherein the shaft portion progressively decreases in diameter.

5. The connector terminal according to claim 1, wherein said tubular portion has an inner side wall, the at least one projection being disposed on the inner side wall.

6. The connector terminal according to claim 5, wherein the at least one projection comprises a pair of projections on opposed portions of the inner side wall.

7. A connector terminal, comprising:

a first terminal having an insertion tubular portion, said insertion tubular portion having at least one projection, said projection being blade-like and having a width substantially equal to an inner diameter of said insertion tubular portion;

a second terminal having a slotted shaft portion insertable into the first terminal, the slotted shaft portion including an outer diameter that is smaller than an inner diameter of said insertion tubular portion such that the second terminal is loosely fitted in the insertion tubular portion in a first position; and expanding means for expanding the outer diameter of said slotted shaft portion in a second position such that said slotted shaft portion contacts said insertion tubular portion with a predetermined contact pressure, wherein said expanding means enters into said slotted shaft portion.

8. The connector terminal according to claim 7, wherein said insertion tubular portion has a closed end, the at least one projection being disposed on the closed end.

9. The connector terminal according to claim 7, wherein the slot of the slotted shaft portion tapers at its end.

10. The connector terminal according to claim 7, wherein the slotted shaft portion progressively decreases in diameter.

11. The connector terminal according to claim 7, wherein said insertion tubular portion has an inner side wall, the at least one projection being disposed on the inner side wall.

12. The connector according to claim 11, wherein the at least one projection comprises a pair of projections on opposed portions of the inner side wall.

13. A method of electrically connecting a first terminal to a second terminal, the first terminal having a blade-like tubular portion with a width substantially equal to an inner diameter of said tubular portion, the second terminal having a shaft portion and a slot, comprising the steps of:

inserting the second terminal into the first terminal;

fitting the blade-like projection on the first terminal into the slot such that the blade-like projection enters into the slot once the second terminal has been inserted by a predetermined amount;

expanding the second terminal radially outward from an insertion diameter less than the inner diameter to an expanded diameter substantially equal to the inner diameter by the fitting of the projection in the slot; and establishing contact between the first and second terminals by the expanding the second terminal.

14. The connector terminal of claim 1, wherein a depth of said slot in said shaft portion extends along a transverse axis of said shaft portion.

15. The connector terminal of claim 14, wherein said transverse axis is a diameter of said shaft portion.

16. The connector terminal of claim 7, wherein a depth of said slot in said shaft portion extends along a transverse axis of said shaft portion.

17. The connector terminal of claim 16, wherein said transverse axis is a diameter of said shaft portion.

18. The connector terminal according to claim 3, wherein the at least one projection comprises a flat plate.

19. The connector terminal according to claim 18, wherein said flat plate extends from a closed end of said tubular portion.

20. The connector terminal according to claim 7, wherein the at least one projection comprises a flat plate.

21. The connector terminal according to claim 20, wherein said flat plate extends from a closed end of said tubular portion.

22. A connector terminal, comprising:

a first terminal having a tubular portion with an inner diameter, said tubular portion having a closed end and an inner side wall, said inner side wall having at least one projection disposed thereon; and a second terminal having a shaft portion insertable in said tubular portion and a slot, wherein said projection engages said slot to expand said shaft portion from an insertion diameter less than the inner diameter in a first position to an expanded diameter substantially equal to the inner diameter in a second position.

23. The connector terminal according to claim 22, wherein the at least one projection comprises a pair of projections on opposed portions of the inner side wall.

24. A connector terminal, comprising:

a first terminal having an insertion tubular portion, said insertion tubular portion having a closed end and an inner side wall, said inner side wall having at least one projection disposed thereon;

a second terminal having a slotted shaft portion insertable into the first terminal, the slotted shaft portion including an outer diameter that is smaller than an inner diameter of said insertion tubular portion such that the second terminal is loosely fitted in the insertion tubular portion in a first position; and means for expanding the outer diameter of said slotted shaft portion in a second position such that said slotted shaft portion contacts said insertion tubular portion with a predetermined contact pressure, wherein said expanding means engages said slotted shaft portion.

25. The connector terminal according to claim 24, wherein the at least one projection comprises a pair of projections on opposed portions of the inner side wall.

* * * * *